US009188338B2

(12) United States Patent
Berteau et al.

(10) Patent No.: US 9,188,338 B2
(45) Date of Patent: Nov. 17, 2015

(54) INJECTOR DEVICE AND COMBUSTION CHAMBER FOR A TURBOMACHINE PROVIDED WITH SUCH INJECTOR DEVICE

(75) Inventors: Patrick Berteau, Arbus (FR); Bernard Joseph Jean Pierre Carrere, Pau (FR); Lorenzo Huacan Hernandez, Pau (FR); Ludovic Andre Joel Naudot, Angais (FR)

(73) Assignee: TURBOMECA, Bordes (FR)

( * ) Notice: Subject to any disclaimer, the term of this patent is extended or adjusted under 35 U.S.C. 154(b) by 792 days.

(21) Appl. No.: 13/522,511

(22) PCT Filed: Jan. 18, 2011

(86) PCT No.: PCT/FR2011/050085

§ 371 (c)(1),
(2), (4) Date: Jul. 17, 2012

(87) PCT Pub. No.: WO2011/086336

PCT Pub. Date: Jul. 21, 2011

(65) Prior Publication Data

US 2012/0291441 A1 Nov. 22, 2012

(30) Foreign Application Priority Data

Jan. 18, 2010 (FR) ..... 10 50286

(51) Int. Cl.
*F23R 3/28* (2006.01)
*F23R 3/12* (2006.01)

(52) U.S. Cl.
CPC ..... *F23R 3/12* (2013.01)

(58) Field of Classification Search
CPC ..... F23R 3/12
USPC ..... 60/737, 748
See application file for complete search history.

(56) References Cited

U.S. PATENT DOCUMENTS

| | | | | |
|---|---|---|---|---|
| 6,279,323 | B1 * | 8/2001 | Monty et al. | 60/752 |
| 6,550,251 | B1 | 4/2003 | Stickles et al. | |
| 2003/0226361 | A1 | 12/2003 | Stickles et al. | |
| 2004/0061001 | A1 | 4/2004 | Mao et al. | |

(Continued)

FOREIGN PATENT DOCUMENTS

| | | |
|---|---|---|
| EP | 0 924 469 | 6/1999 |
| EP | 1 402 956 | 3/2004 |

(Continued)

OTHER PUBLICATIONS

International Search Report Issued May 23, 2011 in PCT/FR11/50085 Filed Jan. 18, 2011.

*Primary Examiner* — Zelalem Eshete
(74) *Attorney, Agent, or Firm* — Oblon, McClelland, Maier & Neustadt, L.L.P.

(57) ABSTRACT

A low-cost combustion chamber injector device that has sturdier construction and is safer for use. Parts are configured specifically to be nested, to dispense with welding between the cellular parts. The device for injecting a fuel-air mix includes, centered on a single axis, a swirl chamber including at least two annular air suction parts, a centering guide, and a retainer ring. The annular parts have cellular conduits connecting to axial inner and outer Venturi tubes. The parts are coaxially mounted, the inner part being configured to be self-centered in the outer part by engagement of the axial and radial walls and then, after assembly, the outer part is welded to the retainer ring and to the inner part in a single radial plane.

10 Claims, 3 Drawing Sheets

(56) References Cited

U.S. PATENT DOCUMENTS

| | | | |
|---|---|---|---|
| 2005/0262843 | A1 | 12/2005 | Monty |
| 2006/0059915 | A1 | 3/2006 | Furletov et al. |
| 2007/0012048 | A1 | 1/2007 | Buret et al. |
| 2008/0000234 | A1 | 1/2008 | Commaret et al. |

FOREIGN PATENT DOCUMENTS

| | | |
|---|---|---|
| EP | 1 600 693 | 11/2005 |
| EP | 1 640 662 | 3/2006 |
| EP | 1 746 348 | 1/2007 |
| EP | 1 873 455 | 1/2008 |

* cited by examiner

INJECTOR DEVICE AND COMBUSTION CHAMBER FOR A TURBOMACHINE PROVIDED WITH SUCH INJECTOR DEVICE

The invention relates to an injector device adapted to provide an appropriate air and fuel mixture that will be then burnt in the combustion chamber of a turbomachine. The invention also relates to a combustion chamber provided with such injector device.

In each turbomachine combustion chamber, at least one injector supplies fuel that is mixed with air in an injector device being fastened to the bottom wall of the chamber. The air is coming from the last stage of a compressor of the turbomachine and is introduced in the injector device in an annular way. Fuel is introduced upstream through a nozzle, being formed on the end of a manifold and adjusted in a centring guide, the injector device is provided with. Air and fuel are mixed and then burnt in the chamber to generate very hot gazes.

As illustrated on FIG. 1*a*, air introduction is conventionally performed in the injector device 1 through a swirl chamber 4 made of two annular parts 12 and 14, each presenting air suction cells being circumferentially distributed. A retainer ring or cover 16 enables through welding to the upstream part 12—according to the fuel flow—to couple a fuel injection manifold 17 to the cellular parts.

The cellular parts 12 and 14 axially follow each other and are welded to each other. The cells form a plurality of slits 15 radially extending and arranged on the circumference of each part. Integral welds 18 and 19 between the parts form radial walls for such slits 15. Said slits are oriented from one part to the other along two directions making opposed angles with respect to any radius centred on the axis. The air swirls in opposed direction form in the Venturi tubes overlapping air patches and in which fuel particles are going to homogenously mix, thereby favouring the air-fuel mix.

Such an injector device thus comprises three annular welds: the welds 18 and 19 making each part integral and one weld 20 between the retainer ring 16 and the first part 12. The welds being close to the slits 15 need to develop costly specific means so as to limit the slit distortion upon manufacturing.

Indeed, as shown on FIG. 1*a*, the welds 18 to 20 of the injector device 1 are difficult to be implemented and have not a reproducible character. Specifically, the welds 18 and 19 distort the slits, which is harmful for the air flow.

The invention aims at remedying such problems; in particular, it aims at providing an injector device of a substantially less high cost, easier to manufacture and sturdier.

To do so, the invention proposes to configure the parts according to a particular nesting to dispense with welding between the cellular parts.

More precisely, the object of the present invention is to provide a fuel-air mix injection device comprising, being centred on a same axis, a swirl chamber having at least two annular air suction parts, being external and internal, a centring guide and a retainer ring, and in which the annular parts present cellular conduits opening into external and internal coaxial Venturi tubes, formed by internal axial walls. The parts are coaxially mounted, the internal part being adapted to be self-centred in the external part by contacting axial and radial walls. The retainer ring, the external part and the internal part are welded together in a same radial plan along opposite radial faces, the retainer ring capping the centring guide so as to hold it in a radial housing. Advantageously, the welding bead then immobilizes the internal in rotation.

According to particular embodiments of the injector device:

- the air conduits of the external part are regularly distributed on two crowns orthogonally to the axis, the conduits of one crown being able to be oriented according to an angle of an opposed direction or a same direction compared to the one of the conduits of the other crown with respect to a radius from the axis;
- the angles of opposed directions are comprised in the ranges of ±20 to 40°;
- the conduits of the internal part are arranged in the extension of the conduits of one crown of the external part and open into the internal Venturi tube, the conduits of the other crown of the external part opening into a space formed between the internal and external Venturi tubes;
- the conduits of the internal part are adapted to be realized in the extension of the conduits of a crown of the external part after centring the internal part in the external part and welding with the retainer ring;
- the conduits are of a section having substantially the same dimension in at least two perpendicular directions; in particular the conduits are cylindrical with a circular or square section;
- the number of conduits of the crowns is identical, the conduits of one crown being offset by half a pitch on the periphery of the external part;
- the retainer ring presents a radial bevelled edge adapted to make positioning of the internal part on the external part easier;
- the centring guide receiving the injection nozzle is adaptable in position into a radial housing made between the radial wall of the retainer ring and the radial wall of the internal part through an adapted dimensioning of the retainer ring and/or of a collar formed on the centring guide.

The invention also relates to a combustion chamber provided with an injector device such as defined above. The chamber comprises an annular wall and a bottom wall, fastening means for the injector device being arranged in the chamber bottom wall presenting a passage opening for the fuel injection nozzle being coupled to the centring guide.

Other characteristics and advantages of the present invention will appear upon reading the detailed following exemplary embodiment referring to the accompanying FIGS., wherein:

FIGS. 1*a* and 1*b* are perspective views of an exemplary injector device according to the prior art upon or after manufacturing (already commented);

The term "internal" or equivalent and the term "external" or equivalent relate respectively to the location of parts of one element or equivalent elements relatively located the closest and the farthest from the symmetry axis X'X. The terms "upstream" and "downstream" or equivalent designate element parts referring to the fuel flow in the injector device according to the axis X'X.

Figure 1A:
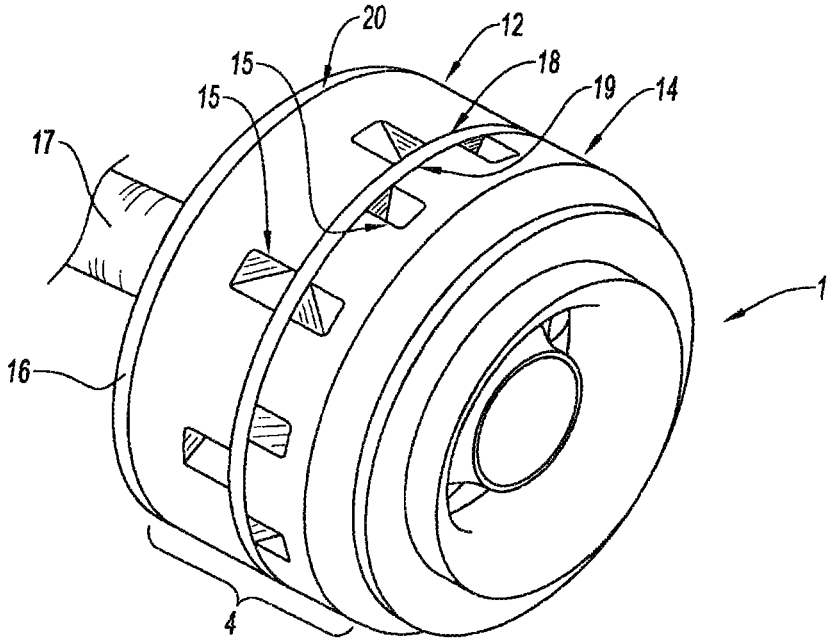
Figure 1B:
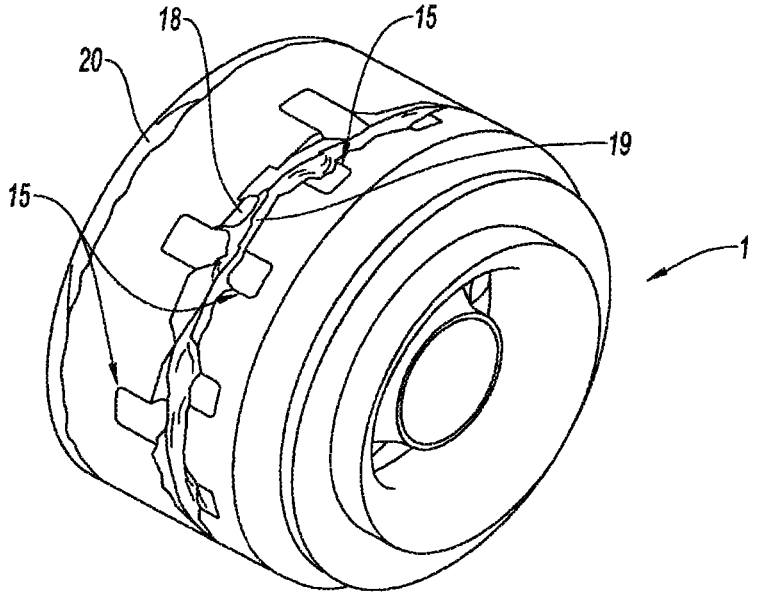
Figure 2:
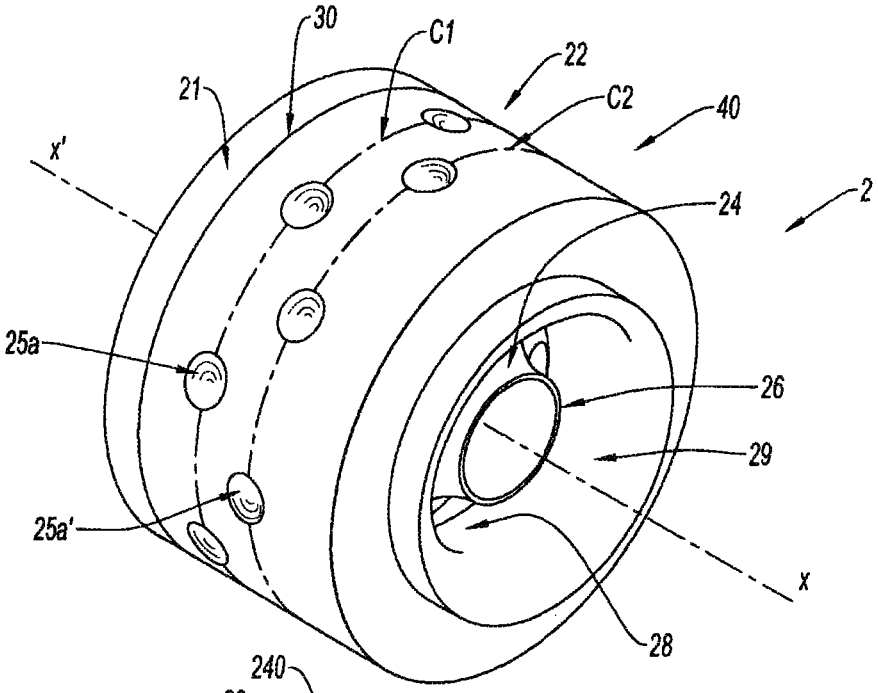
FIG. 2 is a perspective view of an exemplary embodiment according to the present invention.

Referring now to the perspective view of FIG. 2 of an exemplary injector device according to the invention, there is one single annular weld 30 between a first cellular part 22 of the swirl chamber 40—so-called external part—and the retainer ring 21 of the injector device 2. The second cellular part 24 of the swirl chamber 40—so called internal part—is coaxial to the first one and forms, on the side oriented towards the combustion chamber 100, an internal Venturi tube 26 located in the opening 29 of the external Venturi tube 28 formed by the internal wall of the first part 22. The cells of the part 22 are cylindrical conduits 25*a* and 25*a*' of a circular section, being regularly distributed according to annular crowns C1 and C2 and respectively oriented in two directions forming two angles of an opposed direction relative to any radius perpendicular to the symmetry axis XX of the injector device 2. The number of conduits of each crown is identical and the conduits are offset by half a pitch on the external periphery of the part 22.

Figure 3:
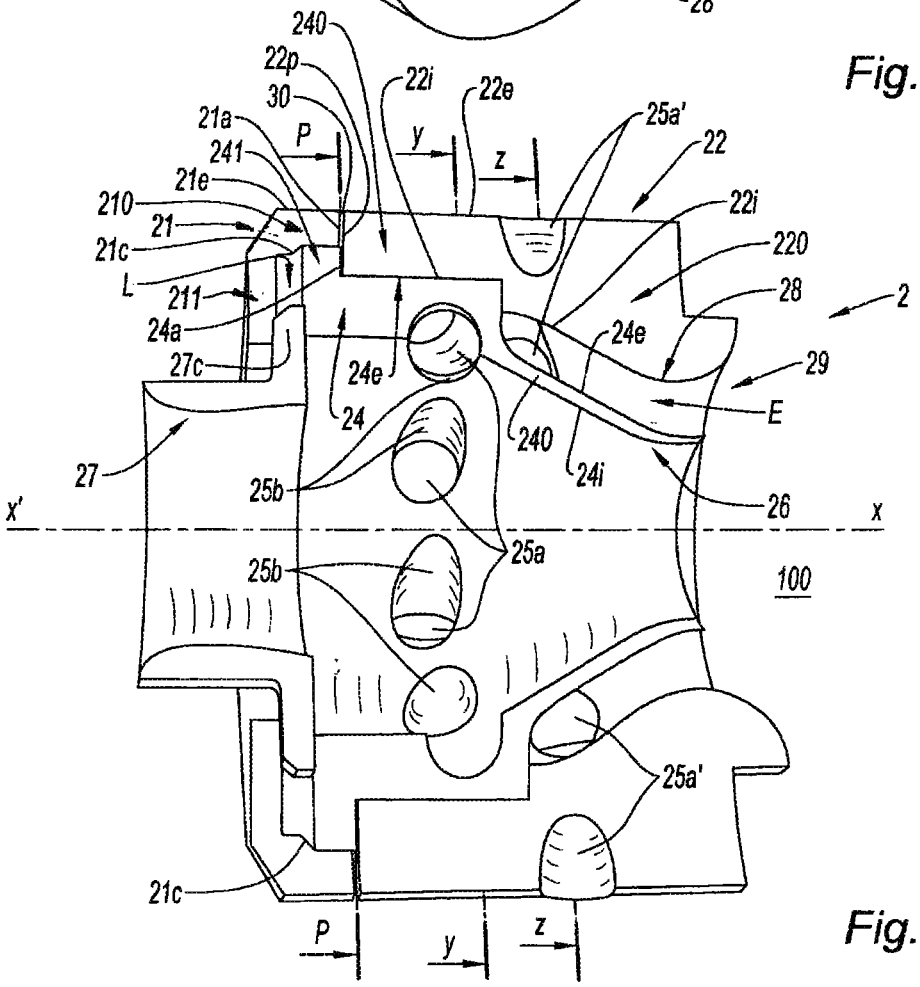
FIG. 3 is a longitudinal sectional view of the preceding exemplary embodiment.

The longitudinal sectional view of FIG. 3 illustrates the mounting between the different elements constituting such injector device 21. The longitudinal wall 220 of the external part 22 has an external face 22*e*, being parallel to the axis XX, and an internal face 22*i* being parallel—upstream—to the axis X'X and tapering—downstream—towards the opening 29 in the direction of the combustion chamber 100. Such tapering portion forms the external Venturi tube 28.

The internal 22*i* and external 22*e* faces of the external part 22 are connected upstream by a radial face 22*p* being perpendicular to the axis X'X. The second part 24 or internal part, being coaxial and concentric to the external part 22, has a so-called radial wall 241 being perpendicular to the axis X'X and a so-called longitudinal wall 240 extending according to such symmetry axis. The radial wall 241 has a downstream face 24*a* and the longitudinal wall 240 has an external face 24*e* respectively arranged against the faces 22*p* and 22*i* of the part 22. The conduits 25*a* of the first crown of the part 22 are extended by conduits 25*b* formed in the extension of the first conduits 25*a*. The conduits are made after assembling, once both parts 22 and 24 of the swirl chamber are embedded in each other through their opposite faces and welded to the retainer ring 21, thereby implementing a perfect alignment.

The external face 24*e* of the wall 240 of the internal part 24 stays against the internal face 22*i* of the external part only in their upstream portion. In the downstream portion, the wall 240 does not stay parallel to the axis X'X, but tapers towards such axis so as to form, within its internal face 24*i*, the internal Venturi tube 26 and form, from its external face 24*e*, an inter-Venturi space E between the two Venturi tubes 26 and 28. The conduits 25*a*' of the second crown of the part 22 open into such space E.

Upstream, the radial wall 241 is capped by the retainer ring 21, the external annular face 21*c* comes in the extension of the external annular face 22*e* of the external part 22, in parallel to the symmetry axis X'X. The ring 21 comprises an annular wall 210 and a radial wall 211. A radial housing L is defined between the radial walls 211 and 241 for the collar 27*c* of the centring guide 27. The radial housing L is over-dimensioned relative to the collar 27*c* through an appropriate dimensioning of the radial 211 and annular 210 walls of the ring, so that the guide 27 is adapted in position by a displacement within the plan of the housing L. Alternately, an appropriate dimensioning of the collar 27*c* of the centring guide 27 also allows a double freedom degree to be offered to such guide.

Furthermore, the annular wall 210 advantageously presents a bevelled edge 21C in the internal face so as to position the part 24 on the part 22.

After assembling, the part 22 is welded to the ring 21 and to the internal part 24 by the bead 30 deposited in a same radial plan P between the radial face 22*p* of the external part 22, on the one side, and the radial faces 21*a* of the ring 21 and 24*a* of the internal part 24 located opposite, on the other side. At least one of the walls to be welded is advantageously bevelled so as to make such welding. The internal part 24 is then self-centred on two perpendicular walls by embedding in the first part 22, and the welding bead 30 immobilized it in rotation.

Figure 4A:
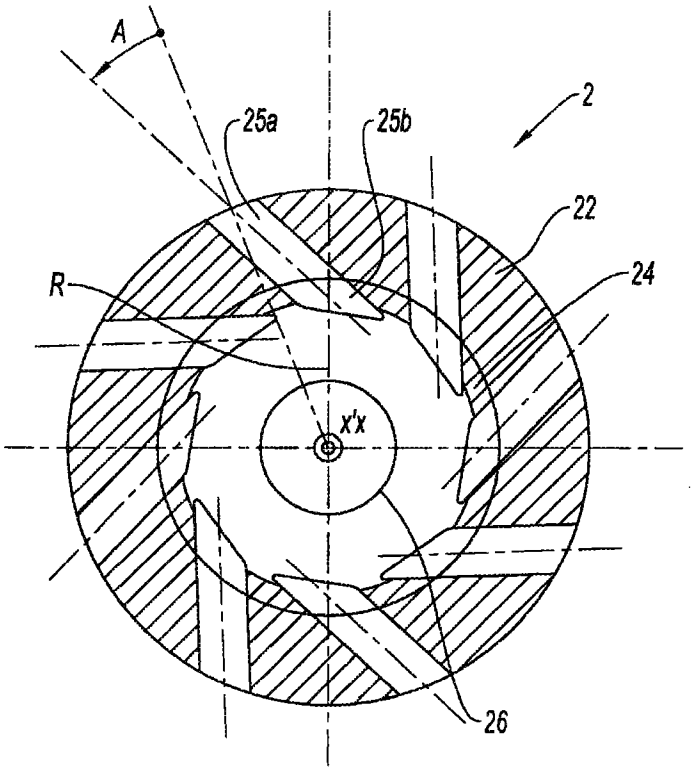
FIGS. 4*a* and 4*b* are sectional views along the plans YY and ZZ of the view according to FIG. 3.
Figure 4B:
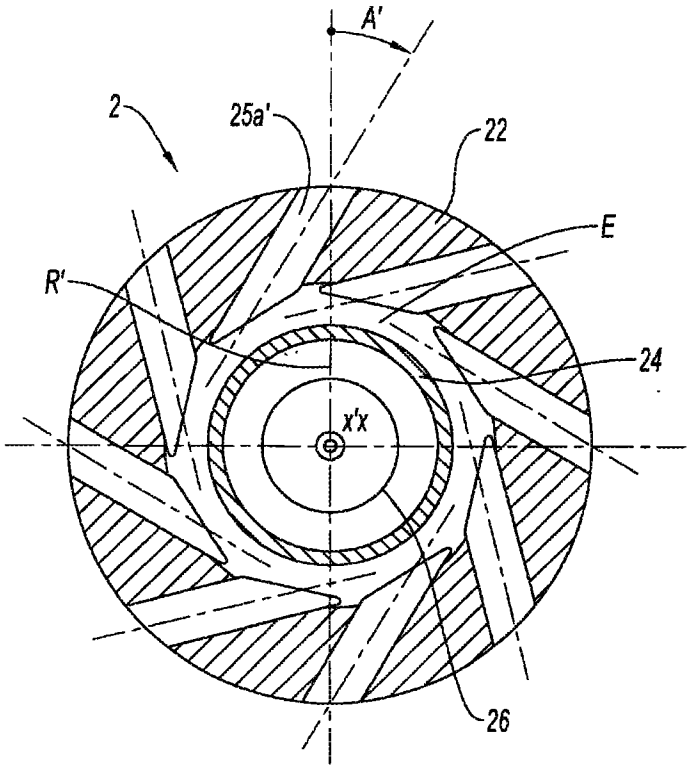

The sections of the injector device 2 according to FIGS. 4*a* and 4*b* illustrate the orientation of an opposed direction of both series of conduits 25*a* and 25*b*, on the one side, and 25*a*' on the other side. On such section also appear the external and internal parts 22 and 24, the internal Venturi tube 26 as well as the inter-Venturi space E (FIG. 4*b*). The angles A and A' of an opposed direction being formed by such conduits relative to radii R and R' passing through the symmetry axis X'X and through the centre of the conduits 25*a* and 25*a*' in the periphery of the injector device 2, are included between ±20 and 40°.

The injector device is then fastened within a chamber comprising an annular wall and a bottom wall. The fastening means for the injector device are arranged in the bottom wall of the chamber showing a passage opening for the fuel injection nozzle to be coupled to the centring guide.

In operation, fuel is injected in each injector device by a nozzle being engaged on the centring guide 27 (FIG. 3) and air through the annular conduits. For example, at the maximum take off power, air enters at the speed of 25 g/s, i.e. about 245 m/s and the fuel at 5 g/s, i.e. about 50 m/s. The air swirls form in the internal Venturi tube 26 and in the inter-Venturi space E air patches of an opposed direction that will overlap at the inlet of the combustion chamber. In each patch, the fuel particles being injected will be mixed on a fluidic and uniform way, thereby implementing a high performance air-fuel mix.

The invention is not limited to the exemplary embodiment described and represented. It is for example possible to form more than two crowns of conduits, for instance four crowns, two of which open into the inter-Venturi space and two other in the internal Venturi. Furthermore, the gyration effect produced by the Venturi tubes is balanced in the different crowns of conduits by adapting the inclination angle of the conduits.

The invention claimed is:

1. A fuel-air mix injector device comprising, centered on a same axis:

a swirl chamber including at least an external annular air suction part and an internal annular air suction part;

a centering guide; and a retainer ring;

wherein the annular parts present cellular conduits opening into external and internal coaxial Venturi tubes formed by internal axial walls, and the parts are coaxially mounted, the internal part is configured to be self-centered in the external part by contacting axial and radial walls, and the retainer ring, the external part, and the internal part are welded together in a same radial plane along opposite radial faces, the retainer ring capping the centering guide so as to hold it in a radial housing.

2. The injector device according to claim 1, wherein air conduits of the external part are cylindrical and regularly distributed on two crowns orthogonally to the axis, the conduits of one crown being oriented according to an angle of an opposed direction compared to one of the conduits of the other crown with respect to a radius from the axis.

3. The injector device according to claim 1, wherein angles of opposed directions formed between the conduits and radii pass through the symmetry axis and the center of the conduits in the periphery of the injector device are between ±20° ands 40°.

4. The injector device according to claim 1, wherein the conduits of the internal part are arranged in an extension of the conduits of one crown of the external part and open into an internal Venturi tube, the conduits of the other crown of the external part opening into a space formed between the internal and external Venturi tubes.

5. The injector device according to claim 4, wherein the conduits of the internal part are realized in an extension of the conduits of one crown of the external part after centering the internal part in the external part and welding with the retainer ring.

6. The injector device according to claim 2, wherein the conduits are of a section having substantially a same dimension in at least two perpendicular directions.

7. The injector device according to claim 2, wherein a number of conduits of one crown is equal to that of the other crown and the crowns are offset by half a pitch on a periphery of the external part.

8. The injector device according to claim 1, wherein the retainer ring presents a bevelled edge configured to make positioning of the internal part on the external part easier.

9. The injector device according to claim 1, wherein the centering guide includes a collar and is adaptable in position into a radial housing made between a radial wall of the retainer ring and a radial wall of the internal part through an adapted dimensioning of the retainer ring and/or the collar of the centering guide.

10. A combustion chamber comprising an injector device according to claim 1, comprising an annular wall and a bottom wall, fastening means for the injector device being arranged in the chamber bottom wall presenting a passage opening for a fuel injection nozzle being coupled to the centering guide of the injector device.

* * * * *